US005150544A

United States Patent [19]

Burnett

[11] Patent Number: 5,150,544

[45] Date of Patent: Sep. 29, 1992

[54] MAGNETICALLY MOUNTED DOOR SWEEP

[75] Inventor: Viola C. Burnett, Farmington, N.Y.

[73] Assignee: Schlegel Corporation, Rochester, N.Y.

[21] Appl. No.: 750,989

[22] Filed: Aug. 28, 1991

[51] Int. Cl.[5] ..... E06B 7/16

[52] U.S. Cl. ..... 49/493; 49/470; 49/506

[58] Field of Search ..... 49/493, 478, 475, 470, 49/506

[56] References Cited

U.S. PATENT DOCUMENTS

| | | | |
|---|---|---|---|
| 1,787,523 | 1/1931 | Heinen | 49/470 |
| 2,611,158 | 9/1952 | Gregory . | |
| 2,857,633 | 10/1958 | Bunker . | |
| 3,111,728 | 11/1963 | Alderfer | 49/478 |
| 3,604,152 | 9/1971 | Protzman . | |
| 3,730,152 | 5/1973 | Shanok et al. . | |
| 4,192,101 | 3/1980 | White . | |
| 4,198,453 | 4/1980 | Olson | 49/493 X |
| 4,413,446 | 11/1983 | Dittrich . | |
| 4,463,523 | 8/1984 | Mailand et al. . | |
| 4,702,038 | 10/1987 | Frey . | |
| 4,832,396 | 5/1989 | Moreno et al. | 49/478 X |

FOREIGN PATENT DOCUMENTS

| | | |
|---|---|---|
| 868065 | 7/1949 | Fed. Rep. of Germany . |
| 1526154 | 4/1968 | France . |
| 1-312190 | 12/1989 | Japan . |
| 2181772A | 10/1986 | United Kingdom . |

*Primary Examiner*—Philip C. Kannan
*Attorney, Agent, or Firm*—Cumpston & Shaw

[57] ABSTRACT

A magnetically mounted door sweep having a magnetic coor engaging portion for securing the sweep to the door and an integral seal retaining portion for cooperatively engaging a seal. The door engaging portion of the door sweep includes a substantially planar surface which magnetically attaches to the metallic door. The seal retaining portion is configured to cooperatively engage and retain a seal relative to the door and the threshold.

7 Claims, 1 Drawing Sheet

MAGNETICALLY MOUNTED DOOR SWEEP

The present invention relates to door sweeps, more particularly, to a magnetically mounted door sweep for metallic doors, wherein the sweep includes a magnetic door engaging portion and an integral seal retaining portion for orienting a seal relative to the door and a threshold.

BACKGROUND OF THE INVENTION

Attractive magnetic force has been used in the field of sealing movable doors. A magnetic weatherstrip assembly for thresholds is disclosed in U.S. Pat. No. 2,611,158 to Gregory. Gregory employs a magnetic weatherstrip assembly wherein a movable weatherstrip element is caused to be shifted into engagement with the door bottom under the influence of magnets installed in the door bottom.

Similarly, U.S. Pat. No. 3,604,152 to Protzman discloses a threshold assembly including complementary magnetic elements on the door and the threshold.

U.S. Pat. No. 4,192,101 to White discloses a door sealing apparatus having a metal strip applied to the door and a sealing strip having a magnetic portion applied to the frame such that the metal strip and the sealing strip magnetically engage upon closure of the door.

U S. Pat. No. 4,463,523 to Mailand et al. discloses a weatherstrip assembly for an entry door including a stiff portion adhered to the vertical surface of a door and a flexible strip portion extending below the bottom edge of the door and along a threshold. A first magnetic strip is attached to the flexible portion and a second metal strip is adapted to be adhered to the surface of the threshold so that the strips will be face to face and releasably seal between the door and the threshold when the door is closed. The assembly employs a pressure sensitive adhesive for adhering the assembly to the door and the threshold.

Other prior art door sweeps have used mechanical fasteners to retain a seal relative to movable doors. Specifically, the door sweeps are attached to the door by threaded fasteners. The door includes threaded apertures or recesses near the bottom of the door. The door sweep has corresponding holes through which the threaded fastener passes. The holes in the door sweep are usually oval or elongate to provide for adjustment of the sweep relative to the bottom of the door. However, the formation of holes in the door permanently degrades the appearance of the door. In addition, steel doors are susceptible to water penetration around upper seams and joints. The holes in the bottom of the door allow any water which penetrates into the door to weep out to the interior of the room.

SUMMARY OF THE INVENTION

A magnetically mounted door sweep for metallic doors is disclosed. The door sweep includes a magnetic door engaging portion for affixing the sweep to the door, and a seal retaining portion for cooperatively engaging a seal. The seal may be any of a variety of types, configurations and materials including pile, foam or plastic extrusion.

As the present door sweep magnetically mounts to the door, installation of the mount is simplified over the prior art. That is, no mounting holes must be made in the door, or the sweep. This allows simplified retro-fitting of doors. In addition, the sweep may be easily removed for the season, or to change the seal as it needs replacing. In addition, different seals may be employed without requiring restructuring of either the door or threshold.

DETAILED DESCRIPTION OF THE PREFERRED EMBODIMENT

Figure 1:
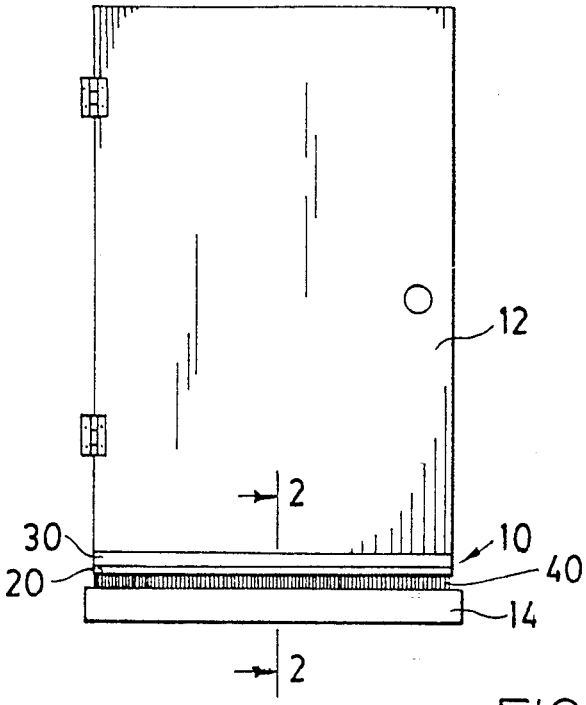
FIG. 1 is a front elevational view of a metallic door employing the magnetically mounted door sweep.
Figure 2:
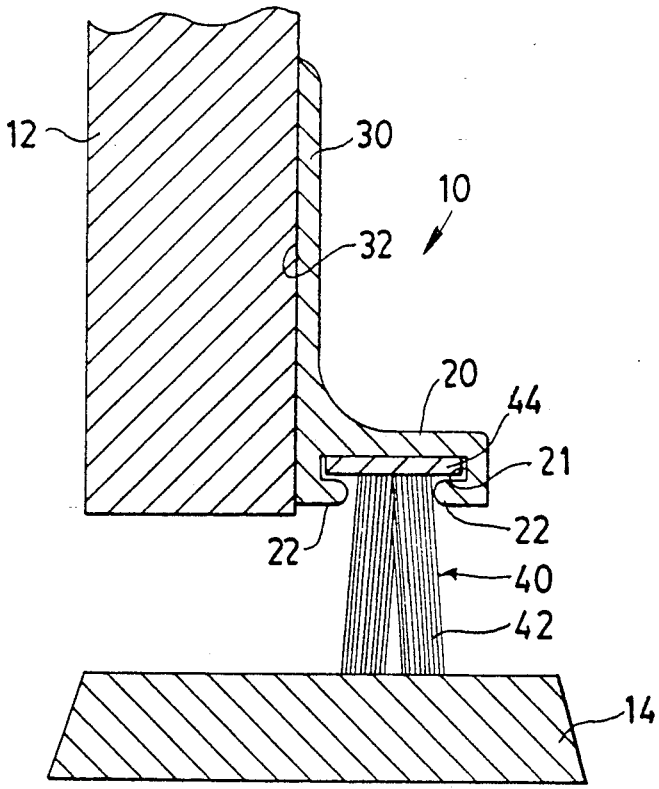
FIG. 2 is a cross sectional view taken along lines 2—2 of FIG. 1 showing the positioning of the door sweep.

As shown in FIG. 1, the door sweep 10 of the present invention is employed adjacent to the bottom of a metallic door 12. The door 12 is movable between an open position and a closed position, wherein the bottom of the door is proximal to a threshold 14 in the closed position. Referring to FIG. 2, the door sweep 10 includes a seal retaining portion 20 and a door engaging portion 30.

The seal retaining portion 20 is configured to releasably engage a seal 40 which may be pile, foam or plastic extrusion. Although shown as releasably engaging the seal 40, the seal retaining portion 20 may be permanently affixed to the seal by adhesives or integral formation. The seal retaining portion 20 typically includes a T-slot defined by a longitudinal recess 21 and a pair of inwardly projecting flanges 22, such that the flanges and the recess define a substantially T-shaped cross section. Although shown as a T-slot, the seal retaining portion 20 may be constructed to accommodate any of a variety of seal shapes, such as pocket type seals including square, round or diamond cross sections, or saw kerf inserts.

As shown in FIG. 2, the door engaging portion 30 extends from the seal retaining portion 20 and defines a substantially planar door engaging surface 32. The door engaging portion 30 includes an embedded magnetic material, or an integrally formed magnetic material such that upon contact with the door 12, the door engaging surface 32 clamps the sweep 10 to the door with sufficient force to preclude creeping of the sweep relative to the door. The magnetic material comprises an EPDM carrier with barium ferrite, or any other magnetic material.

As shown in FIG. 2, the seal retaining portion 20 and door engaging portion 30 are integrally formed to provide a unitary structure. Preferably, the sweep 10 is flexible to assist in installation. The formation of the sweep 10 as a unitary structure including a magnetic material, allows for use of the sweep without requiring the application of secondary adhesives to either the door 12, the sweep, or the threshold 14.

Referring to FIG. 2, the seal 40 includes sealing portion 42 for forming a seal upon contacting a surface, and a backing portion 44 for attaching the seal to the sweep 10.

As shown, the seal retaining portion 20 is vertically offset from the plane of the door engaging portion 30 so that the sweep 10 defines a generally L-shaped cross section. The offset configuration orients the sealing portion 42 so that it is not directly intermediate of the bottom of the door 10 and the threshold 14. Alternatively, the door sweep 10 may be configured so that the seal retaining portion 20 disposes the sealing portion 42 directly between the bottom of the door 12 and the threshold 14 (not shown).

OPERATION

To install the door sweep 10, the desired length of the sweep is determined by measuring the door opening. The door opening extends from door jamb to door jamb and is usually approximately 1/16 to $\frac{1}{8}$ of an inch larger than the width of the door 12. Preferably, the sweep 10 extends across the width of the door opening to slightly overhang the sides of the door. Upon determining the desired length, a corresponding length of the sweep 10 is easily cut from a supply roll or strip (not shown). A corresponding length of seal 40 is then cooperatively engaged with the seal retaining portion 20. The door sweep 10 is then oriented with respect to the bottom of the door 12 so that sealing portion 42 contacts the threshold 14 and the door engaging surface 32 contacts the plane of the door. The magnetic attraction between the door 12 and the sweep 10 fixes the seal 40 relative to the door.

As no holes are required to affix the sweep 10 to the door 12, installation labor and degradation to the door is minimized. In addition, as the sweep may be painted to match the color of the door, and no unsightly holes are required, appearance is enhanced.

If the seal 40 is not required during portions of the year, the entire door sweep 10 may be removed, vertically adjusted, or the seal 40 may be removed. Also, the seal 40 may be easily removed and replaced with the same or different type seals as required by operating conditions.

The magnetic attachment also allows the flexible door sweep 10 to properly orient a seal 40 relative to uneven thresholds 14 or imperfectly hung doors 12.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A door sweep for engaging a metallic door to position a non-magnetic seal relative to a threshold and the door, the non-magnetic seal having a sealing portion and a backing portion, the door sweep comprising:

(a) retaining means for cooperatively engaging the backing portion of the seal to secure the seal relative to the door sweep; and (b) integral magnetic fastening means for releasably magnetically securing the door sweep to the metallic door with sufficient attractive force to dispose the sealing portion of the seal in a non-magnetic adhesive free substantially sealing relation with the threshold.

2. The door sweep of claim 1 wherein the integral magnetic fastening means include a substantially planar magnetic door engaging surface.

3. The door sweep of claim 1 wherein the retaining means is vertically offset from the integral magnetic fastening means.

4. A door sweep for retaining a non-magnetic seal relative to a metallic door and a threshold, comprising:

(a) a magnetic door engaging portion for releasably attaching the door sweep to the metallic door; and (b) an integral seal retaining portion for retaining the seal relative to the door sweep and the threshold in a non-magnetic adhesive free relation.

5. The door sweep of claim 4, wherein the magnetic door engaging portion includes a substantially planar door engaging surface.

6. The door sweep of claim 4, wherein the seal retaining portion is vertically offset from the plane of the door engaging portion.

7. A method of employing a door sweep to locate a non-magnetic seal relative to a metallic door and a corresponding threshold, comprising the steps of:

(a) cooperatively engaging a length of the seal with a seal retaining portion of the door sweep; and (b) magnetically attaching the door sweep to the door such that the seal is disposed in a non-magnetic adhesive free sealing relation with the door and the threshold.

* * * * *